US005305537A

United States Patent [19]

Pascarelli

[11] Patent Number: 5,305,537

[45] Date of Patent: Apr. 26, 1994

[54] PHOTO DISPLAY ARRANGEMENT

[76] Inventor: Robert A. Pascarelli, P.O. Box 112815, Anchorage, Ak. 99511

[21] Appl. No.: 20,610

[22] Filed: Feb. 22, 1993

[51] Int. Cl.[5] ..... G09F 1/10

[52] U.S. Cl. ..... 40/159; 40/661

[58] Field of Search ..... 40/159, 156, 661, 594, 40/152.1; 248/475.1, 489

[56] References Cited

U.S. PATENT DOCUMENTS

| | | | |
|---|---|---|---|
| 1,878,113 | 9/1932 | Cressler | 40/159 |
| 2,828,567 | 4/1958 | Shoan | 40/159 |
| 2,845,000 | 7/1958 | Morley | 248/475.1 |
| 3,343,289 | 9/1967 | Chamberlin | 40/159 X |
| 3,651,591 | 3/1972 | Woodyard | 40/159 X |
| 4,530,482 | 7/1985 | Berison | 248/475.1 |
| 4,592,529 | 6/1986 | Suzuki | 248/475.1 |
| 4,896,027 | 1/1990 | Drexler | 40/159 X |
| 5,000,319 | 3/1991 | Mermelstein | 40/159 X |

FOREIGN PATENT DOCUMENTS

| | | | |
|---|---|---|---|
| 2117547 | 10/1983 | United Kingdom | 40/594 |

*Primary Examiner*—Kenneth J. Dorner
*Assistant Examiner*—J. Bonifanti
*Attorney, Agent, or Firm*—Leon Gilden

[57] ABSTRACT

A mounting web includes a matrix of transparent pockets mounted to the web, wherein the pockets each include an access opening slot permitting reception of a picture web within each pocket. The mounting web is arranged with support heads mounted to a rear wall of the web for securement within a hanger plate, with the hanger plate having a channel to resiliently engage and secure the mounting heads.

3 Claims, 4 Drawing Sheets

PHOTO DISPLAY ARRANGEMENT

BACKGROUND OF THE INVENTION

1. Field of the Invention

The field of invention relates to photo display structure, and more particularly pertains to a new and improved photo display arrangement permitting the ease of mounting and visual display of a matrix of photo webs.

2. Description of the Prior Art

Photo display structure is available in the prior art and exemplified by the U.S. Pat. Nos. 5,025,581; 4,450,638; 4,807,377; and 4,979,323.

The instant invention attempts to overcome deficiencies of the prior art by providing for a photo display arrangement enjoying ease of use as well as effectiveness in construction in the ease of display and the mounting of photos for visual observation and in this respect, the present invention substantially fulfills this need.

SUMMARY OF THE INVENTION

In view of the foregoing disadvantages inherent in the known types of photo display structure now present in the prior art, the present invention provides a photo display arrangement wherein the same is configured to accommodate a plurality of rows and columns of photos for ease of visual display and mounting to a vertical wall support surface. As such, the general purpose of the present invention, which will be described subsequently in greater detail, is to provide a new and improved photo display arrangement which has all the advantages of the prior art photo display structure and none of the disadvantages.

To attain this, the present invention provides a mounting web including a matrix of transparent pockets mounted to the web, wherein the pockets each include an access opening slot permitting reception of a picture web within each pocket. The mounting web is arranged with support heads mounted to a rear wall of the web for securement within a hanger plate, with the hanger plate having a channel to resiliently engage and secure the mounting heads.

My invention resides not in any one of these features per se, but rather in the particular combination of all of them herein disclosed and claimed and it is distinguished from the prior art in this particular combination of all of its structures for the functions specified.

Here has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved photo display arrangement which has all the advantages of the prior art photo display structure and none of the disadvantages. It is another object of the present invention to provide a new and improved photo display arrangement which may be easily and efficiently manufactured and marketed.

It is a further object of the present invention to provide a new and improved photo display arrangement which is of a durable and reliable construction.

An even further object of the present invention is to provide a new and improved photo display arrangement which is susceptible of a low cost of manufacture with regard to both materials and labor, and which accordingly is then susceptible of low prices of sale to the consuming public, thereby making such photo display arrangements economically available to the buying public.

Still yet another object of the present invention is to provide a new and improved photo display arrangement which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
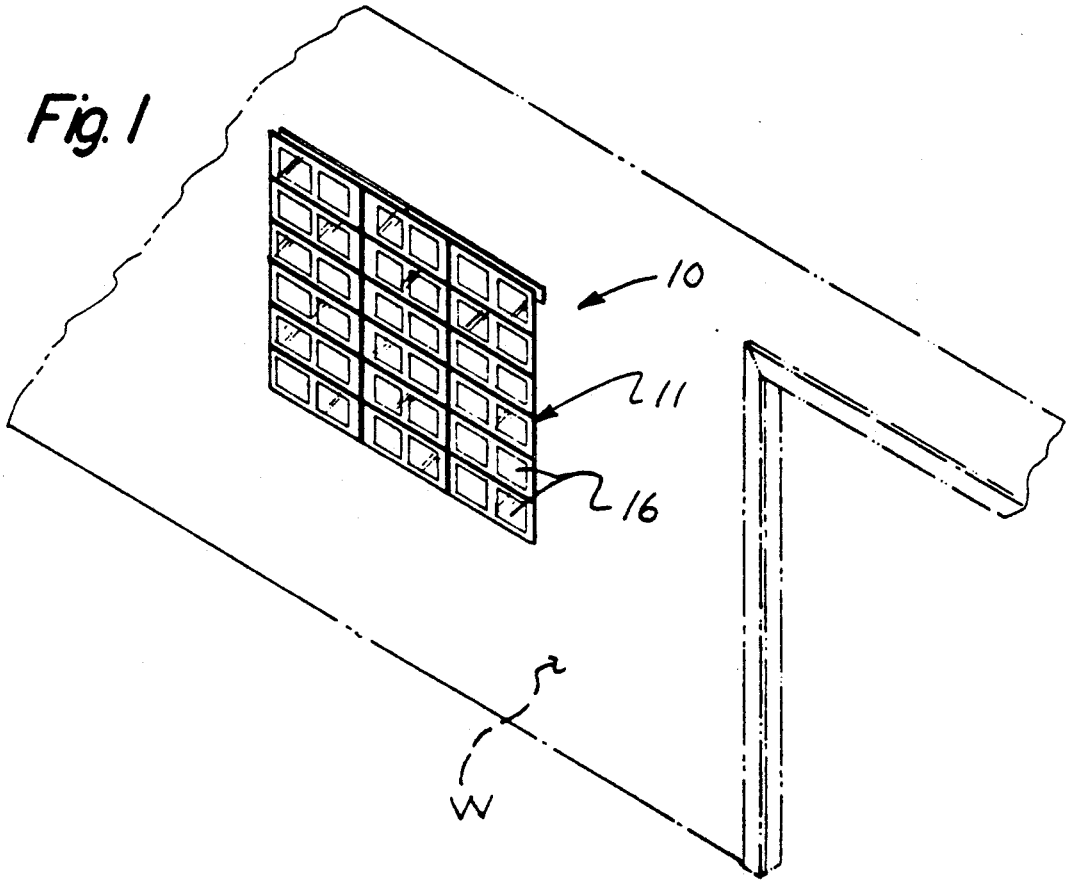
FIG. 1 is an isometric illustration of the invention arranged for mounting upon a support wall.
Figure 2:
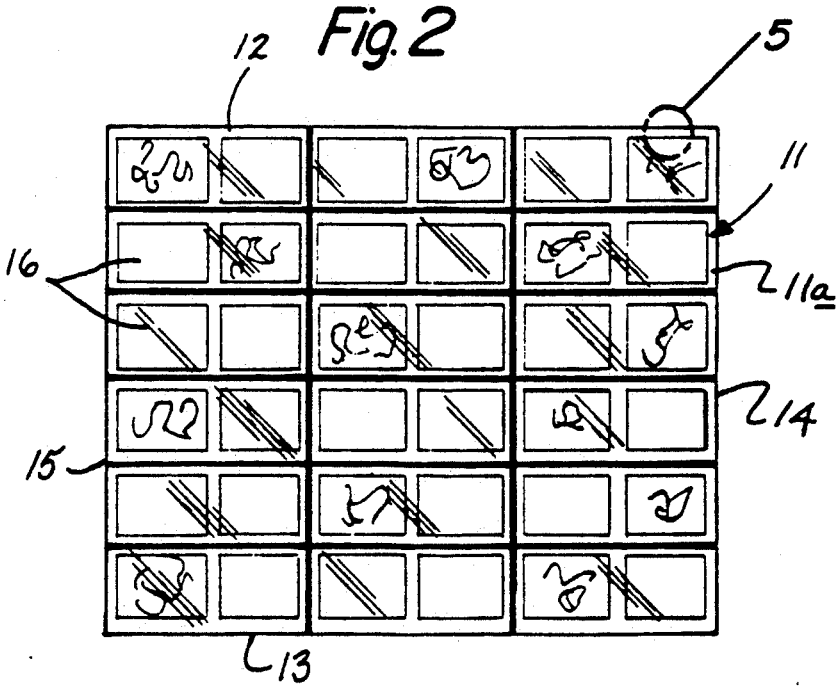
FIG. 2 is an orthographic frontal view of the invention.
Figure 3:
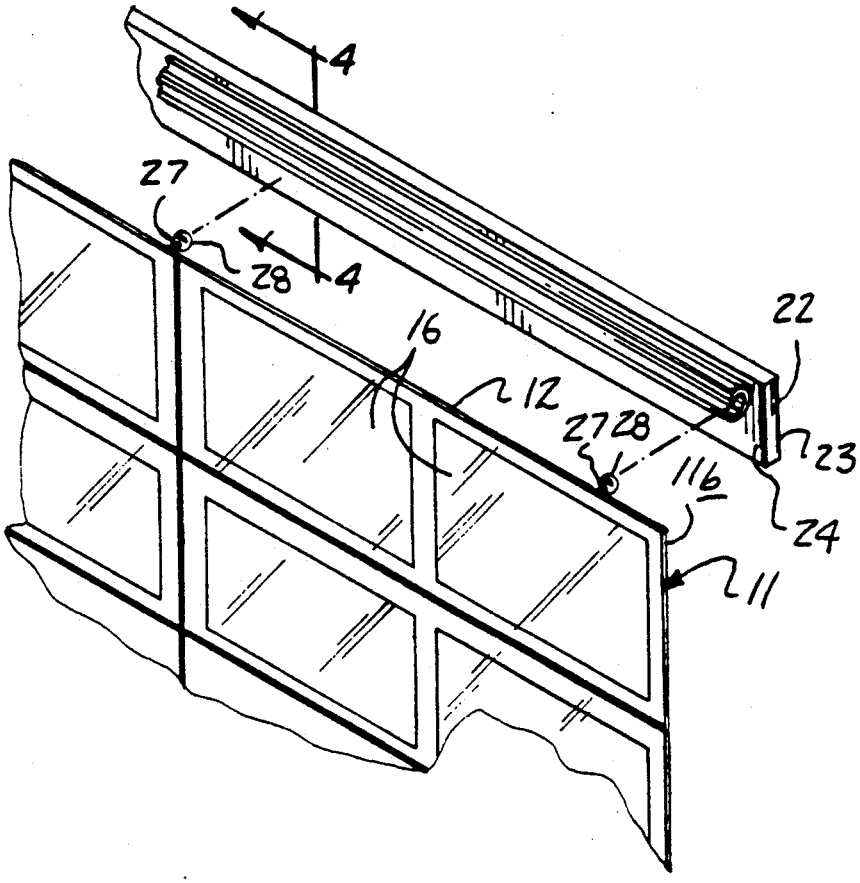
FIG. 3 is an enlarged isometric illustration of the web secured to the hanger plate.
Figure 4:
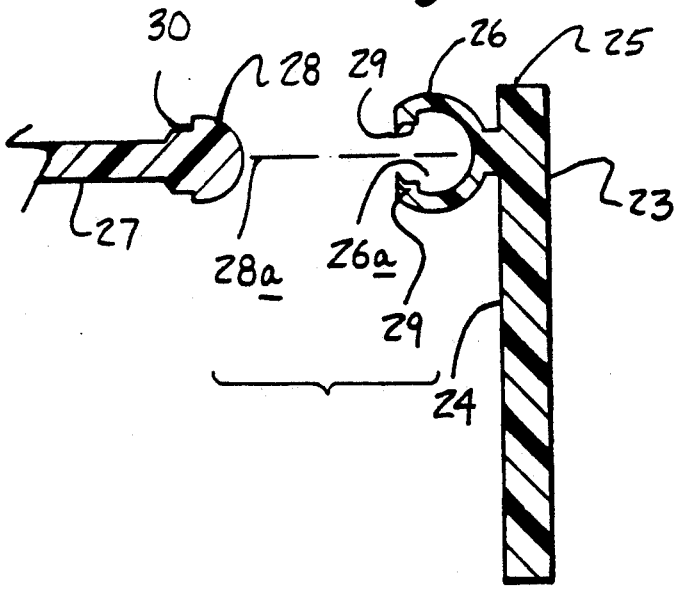
FIG. 4 is an orthographic view, taken along the lines 4—4 of FIG. 3 in the direction indicated by the arrows.

With reference now to the drawings, and in particular to FIGS. to 9 thereof, a new and improved photo display arrangement embodying the principles and concepts of the present invention and generally designated by the reference numeral 10 will be described.

Figure 5:
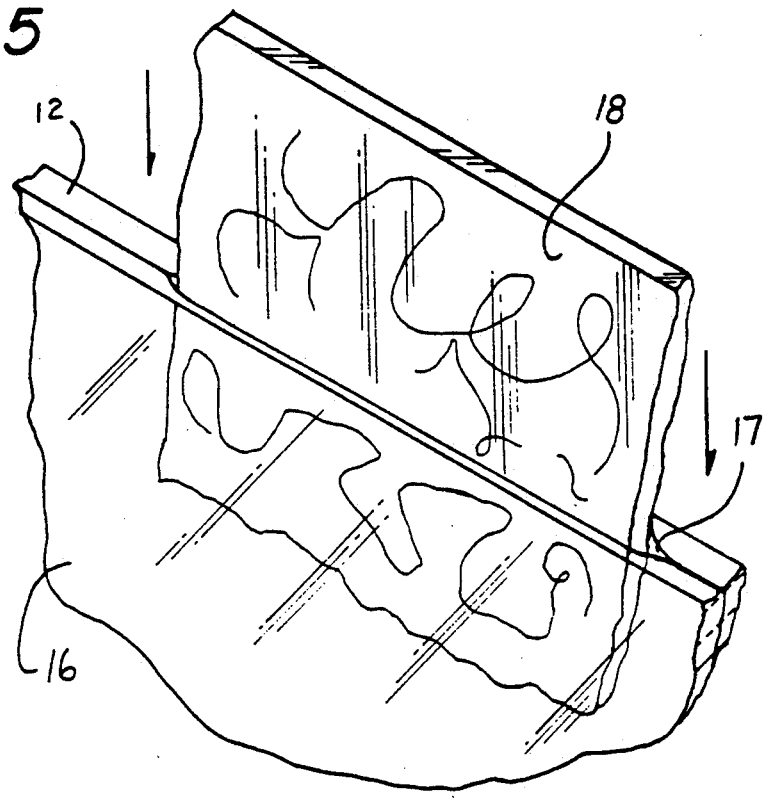
FIG. 5 is an enlarged isometric view of section 5 as set forth in FIG. 2.
Figure 6:
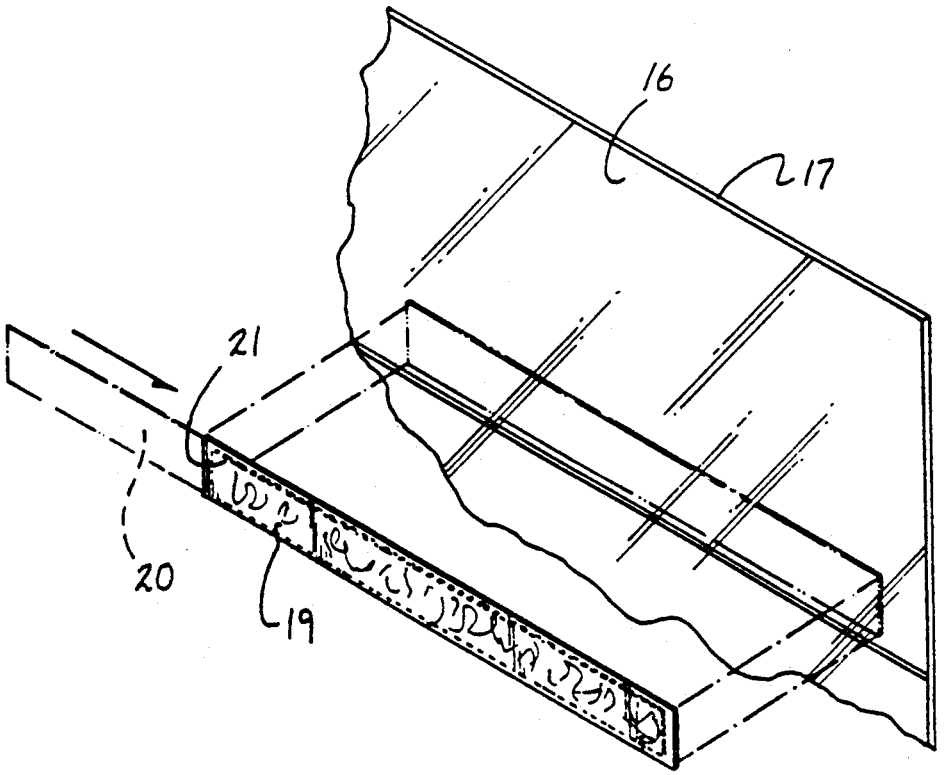
FIG. 6 is an isometric illustration of a transparent pocket receiving an information strip thereon.

More specifically, the photo display arrangement 10 of the instant invention is arranged for securement to a support wall "W", as indicated in FIG. 1. A mounting web 11 is provided, having a web front surface 11*a* spaced from a web rear surface 11*b*. The mounting web further includes a top edge 12 spaced from a bottom edge 13 and spaced first and second side edges 14 and 15 respectively. A matrix of transparent pockets 16 are mounted to the mounting web front surface 11*a*, with the transparent pocket 16 arranged in parallel rows and intersecting parallel columns directed coextensively between the top and bottom edges 12 and 13 and the respective first and second sides 14 and 15. Each of the pockets 13 includes a pocket slot 17 arranged to receive a photo web 18, in a manner as indicated in FIG. 5. An indicator strip 19 is provided, having an adhesive layer on a rear wall of the strip 19 in a facing relationship relative to a respective transparent pocket 16, with the indicator strip 19 having an indicator card 20 arranged for reception with an indicator strip pocket 21 and as the indicator strip is of a transparent material, information imparted upon the indicator card 20 is visible through the indicator strip 19 from the indicator strip pocket 21.

A hanger plate 22 is provided of a rigid construction, having a plate rear wall 23 spaced from a plate front wall 24 and a top end 25. The hanger plate 22 is arranged to accommodate perforations (not shown) orthogonally directed relative to the top end 25 to permit ease of separation of the hanger strip into various lengths as desired. The strip, however, is directed to be used in a coextensive length relative to the mounting web top edge 12, with a C-shaped resilient channel member 26 mounted to the plate front wall 24 in adjacency to the top end 25, with the channel member 26 parallel relative to the top end 25. The channel member 26 includes a channel cavity 26*a*, with channel flanges 29 arranged in a facing relationship relative to one another at the entrance to the channel cavity 26*a*. The channel flanges 29 accordingly are oriented in a substantially coplanar relationship relative to one another. A plurality of post members 27 are orthogonally mounted to the mounting web roof surface 11*b* in adjacency to the web top edge 12. Each post member 27 includes a semi-spherical head 28, wherein the semi-spherical head 28 is arranged for reception within the channel cavity 26*a*. The semi-spherical head includes a head planar annular engaging surface 30 orthogonally oriented relative to an axis 28*a*of the head 28, wherein the engaging surface 30 is arranged to provide for an abutting surface for contiguous abutment with the flanges 29 to maintain the semi-spherical head 28 in a secured relationship within the channel cavity 26*a*.

Figure 8:
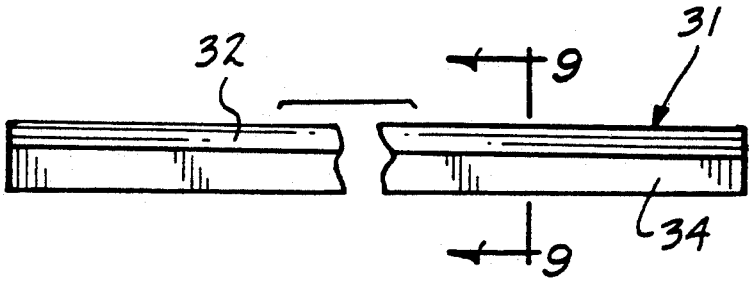
FIG. 8 is an orthographic view of the closure strip.
Figure 9:
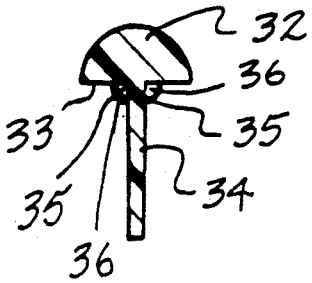
FIG. 9 is an orthographic view, taken along the lines 9—9 of FIG. 8 in the direction indicated by the arrows.
Figure 7:
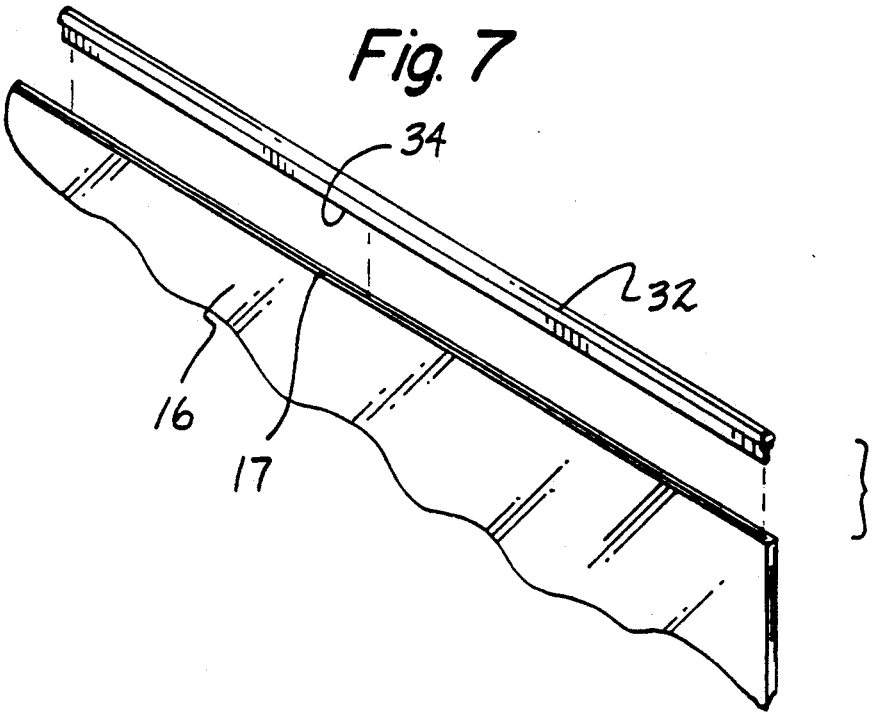
FIG. 7 is an isometric illustration of the invention including a closure strip secured within a respective pocket of the invention.

The FIGS. 7–9 indicate the use of a closure strip 31 that may be optionally employed relative to each of the transparent pocket slots 17. The closure strip 31 includes a semi-cylindrical closure head 32 having a planar engaging surface 33, with an alignment web 34 orthogonally intersecting the engaging surface 33 coextensive with the closure head 32 at a predetermined intersection. An elongate adhesive rupture capsule 35 is mounted at the intersection in communication with the alignment web 34 and the engaging surface 33, with each capsule 35 on each side of the alignment web 34 including a fluid adhesive 36. In this manner, upon projection of the alignment web 34 into the pocket slot 17, the capsules 35 are ruptured and the adhesive effects sealing closure of each picture web within an associated transparent pocket 16.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the are, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A photo display arrangement, comprising, a mounting web, having a web top edge spaced from a web bottom edge, and a web first side spaced from a web second side, and a web front surface spaced from a web rear surface, with the web front surface including a matrix of transparent pockets, including parallel rows of said pockets extending from the web top edge to the web bottom edge and intersecting parallel columns of pockets extending from the web first side to the web second side, with each pocket having a pocket slot directed into the pocket, with the pocket slot arranged to receive a photo web through the pocket slot into the transparent pocket, and hanger means arranged for securement to a support wall for securing the mounting web to the support wall, and an indicator strip arranged for securement to at least one of said pockets, wherein the indicator strip includes a strip rear wall and a strip front wall, the indicator strip formed of a transparent material and an adhesive layer on the strip rear wall in facing relationship relative to said at least one pocket for securing the indicator strip to the pocket, with the indicator strip having an indicator strip pocket, and an indicator card arranged for sliding reception within the indicator strip pocket for providing visual information relative to said at least one pocket, and the hanger means includes a hanger plate, the hanger plate having a plate rear wall spaced from a plate front wall, and a plate top end, with a C-shaped resilient channel member fixedly mounted to the plate front wall in adjacency to the plate top end, wherein the C-shaped channel member includes a channel cavity, and the channel cavity includes a plurality of spaced channel flanges coextensive with the channel member oriented at an entrance to the channel cavity, with the channel flanges arranged in a substantially parallel coplanar relationship relative to one another, and the mounting web rear surface having a plurality of spaced post members, and each post member including a semi-spherical head, with each semi-spherical head arranged for reception within the channel cavity.

2. A photo display arrangement as set forth in claim 1 wherein each semi-spherical head includes a head planar annular engaging surface in adjacency to a respective post member of said post members, and the engaging surface orthogonally oriented relative to a head axis, with the semi-spherical head symmetrically oriented about the head axis, and the head planar annular engaging surface arranged for contiguous and abutting relationship relative to the channel flanges, with the semi-spherical head positioned within the channel cavity.

3. A photo display arrangement as set forth in claim 2 including at least one closure strip arrangement for securement to at least one pocket slot, wherein the closure strip includes a semi-cylindrical closure head having a planar engaging surface, and the planar engaging surface includes an alignment web coextensive with an orthogonally and integrally mounted to the planar engaging surface, and the alignment web secured to the engaging surface at a predetermined intersection, and an adhesive rupture capsule mounted upon each side of the alignment web at the predetermined intersection, with each capsule having a fluid adhesive therewithin, wherein each capsule is arranged for rupturing upon engagement with the pocket slot to seal the closure strip and the planar engaging surface in contiguous communication wit the pocket slot to effect hermetic sealing of a respective pocket of said pockets containing at least one photo web within said at least one pocket.

* * * * *